US008900111B2

(12) United States Patent
Wetsch et al.

(10) Patent No.: US 8,900,111 B2
(45) Date of Patent: Dec. 2, 2014

(54) SHEET-FED DUNNAGE APPARATUS

(75) Inventors: Thomas D. Wetsch, St. Charles, IL (US); Robert Tegel, Huntley, IL (US)

(73) Assignee: Pregis Innovative Packaging, Inc., Deerfield, IL (US)

( * ) Notice: Subject to any disclaimer, the term of this patent is extended or adjusted under 35 U.S.C. 154(b) by 1167 days.

(21) Appl. No.: 12/202,928

(22) Filed: Sep. 2, 2008

(65) Prior Publication Data

US 2009/0075800 A1 Mar. 19, 2009

Related U.S. Application Data

(63) Continuation of application No. PCT/US2008/074907, filed on Aug. 29, 2008.

(60) Provisional application No. 60/966,952, filed on Aug. 31, 2007.

(51) Int. Cl.
*B31B 1/00* (2006.01)

(52) U.S. Cl.
USPC ..... 493/464; 493/459; 493/407; 493/352

(58) Field of Classification Search
USPC ..... 493/464, 463, 459, 407, 352, 350, 967, 493/904
See application file for complete search history.

(56) References Cited

U.S. PATENT DOCUMENTS

| | | | | |
|---|---|---|---|---|
| 2,707,595 | A | 5/1955 | Brown | |
| 2,786,399 | A * | 3/1957 | Mason et al. | 493/369 |
| 2,924,154 | A * | 2/1960 | Russell et al. | 493/464 |
| 3,044,921 | A * | 7/1962 | Wentworth et al. | 156/205 |
| 3,161,557 | A * | 12/1964 | Muller | 156/462 |
| 3,425,888 | A | 2/1969 | Kellicutt | |
| 3,509,797 | A | 5/1970 | Johnson | |
| 3,650,877 | A * | 3/1972 | Johnson | 428/222 |
| 3,692,615 | A | 9/1972 | Koichiro | |
| 4,884,999 | A | 12/1989 | Baldacci | |
| 5,188,581 | A | 2/1993 | Baldacci | |
| 5,813,967 | A | 9/1998 | Davila | |
| 6,106,452 | A | 8/2000 | Baumuller | |
| 6,120,428 | A | 9/2000 | Ratzel | |
| 6,179,765 | B1 | 1/2001 | Toth | |
| 6,632,165 | B1 | 10/2003 | Letourneau et al. | |
| 6,740,274 | B2 * | 5/2004 | Weder et al. | 264/132 |
| 6,758,801 | B2 | 7/2004 | Harding et al. | |
| 6,783,489 | B1 | 8/2004 | Ratzel et al. | |
| 6,910,997 | B1 * | 6/2005 | Yampolsky et al. | 493/464 |
| 7,125,375 | B2 | 10/2006 | Kung et al. | |
| 7,260,922 | B2 | 8/2007 | Harding et al. | |

FOREIGN PATENT DOCUMENTS

| | | |
|---|---|---|
| JP | 38-002011 | 3/1963 |
| JP | 08-001837 | 1/1996 |
| KR | 10-2002-0073610 | 9/2002 |
| WO | WO-95/29055 | 11/1995 |

OTHER PUBLICATIONS

International Search Report and Written Opinion dated Jan. 19, 2009 for PCT/US2008/074907.

* cited by examiner

*Primary Examiner* — Sameh H. Tawfik
(74) *Attorney, Agent, or Firm* — Dorsey & Whitney LLP

(57) ABSTRACT

The preferred embodiment of a dunnage apparatus includes a crumpling device configured for crumpling sheets of paper to produce low-density packaging dunnage. A paper feeder is provided to feed feeding sheets of paper into the crumpling device for crumpling.

2 Claims, 3 Drawing Sheets

SHEET-FED DUNNAGE APPARATUS

CROSS-REFERENCE TO RELATED APPLICATIONS

This application is a continuation of International Application No. PCT/US2008/074907, filed Aug. 29, 2008, entitled "SHEET-FED DUNNAGE APPARATUS" and claims priority benefit of U.S. Provisional Patent Application No. 60/966,952, filed Aug. 31, 2007, entitled, "SINGLE SHEET FEED AND CRUMPLING APPARATUS," the contents of which applications are hereby incorporated herein by reference thereto.

TECHNICAL FIELD

The present subject matter relates generally to an apparatus for producing dunnage for protective packaging.

BACKGROUND

Products to be transported and/or stored often are packed within a box or other container. In many instances, however, the shape of the product does not match the shape of the container. Most containers utilized for transporting products have the general shape of a square or rectangular box and, of course, products can be any shape or size. To fit a product within a container and to safely transport and/or store the product without damage to the product, the void space within the container is typically filled with a packing or cushioning material. The packing material utilized to fill void space within a container is often a lightweight, air-filled material that may act as a pillow or cushion to protect the product within the container. In many circumstances, a plastic bubble material is utilized to protect and cushion the product contained within a container.

Small Styrofoam nuggets or "peanuts" may also be utilized to fill void space within containers for protecting and cushioning a product within a container during transport and/or storage. These nuggets or "peanuts" normally need to entirely fill the void space within the container to adequately protect the packaged product. In addition, it is also difficult to contain the Styrofoam nuggets or "peanuts" within the container, especially after the container has been opened.

Another typical material utilized for filling void space within containers, and for protecting and cushioning a product contained within the container, is paper and/or paper substrates. Typically, sheets of paper material can be crumpled so as to form long shapes having many folds or pleats. Lengths of crumpled paper can be created to easily and effectively fill void space within a container holding a product. Because the paper has fold spaces and/or pleats, the crumpled paper can be very effective at protecting and cushioning a product contained within the container, and may effectively prevent damage to the product during transport and/or storage.

Sheets of paper may be crumpled by hand, in that a person may take a length of a sheet of paper, and crumple the paper to form various shapes to fill void space within a container to protect and cushion a product contained therein. Hand crumpling paper takes much time, and is not effective and/or efficient to provide a large amount of crumpled paper as may be needed in a production line. Machines, therefore, are used to crumple paper.

Typical machines utilized to crumple paper generally take a length of a sheet of paper, and feed the paper into a crumpling zone of the machine to provide a crumpled paper product. Long sheets of paper substrate material are typically provided on rolls and are fed into machines at a high rate of speed. Certain issues must be overcome when using rolls to control the rate of speed for the paper substrate to be removed from the roll, which often is done with a braking mechanism to prevent the roll from unwinds at a higher rate of speed than the paper is being fed into the machine, which can cause paper to spill off the roll. This can occur when the rate of feeding of the paper into the crumpling machine slows, and momentum causes the roll, which is heavy with paper, to continue rolling. Using a roll also requires a cutting mechanism to cut the desired lengths of crumpled paper.

A need, therefore, exists for a dunnage apparatus that can allow improved operation feeding and/or crumpling mechanism made from relatively soft materials that may solve the problems associated with utilizing metal in the feeding and/or crumpling mechanisms.

SUMMARY

The present subject matter relates generally to an apparatus for crumpling paper sheeting for use in packaging. To this end, in an embodiment of the present invention, a dunnage apparatus is provided comprising a crumpling device configured for crumpling sheets of a substrate to produce low-density packaging dunnage, and a feeder configured for feeding separate sheets of the substrate paper into the crumpling device for crumpling.

The paper feeder can be configured for feeding the sheets from a stack to the crumpling device, and for feeding individual sheets to the crumpling device. The paper feeder can feed more than one of the sheets at a time in an overlapping arrangement into the crumpling device.

The dunnage preferably comprises a supply tray configured and dimensioned for holding the sheets arranged as a stack, wherein the paper feeder is disposed and configured for feeding the sheets of paper from the supply tray to the crumpling device. The paper feeder can be configured for drawing the sheets from the top of the stack to the crumpling device. The paper feeder can comprise a drive roller positioned to engage a sheet on the surface of the stack for feeding the sheets. The paper feeder and the tray can be associated movably to accommodate a varying thickness of the stack.

In the preferred embodiment, the dunnage apparatus has a feed guide disposed for cooperating with the paper feeder for guiding the sheets into the crumpling device. The feed guide can be movable with respect to the paper feeder and crumpling device to accommodate a varying thickness of the stack. The feed guide can be disposed for engaging an opposite surface of the sheets than the paper feeder.

The crumpling device can be configured for forming crumples in the paper that are oriented generally in a direction transverse to a direction of travel of the paper through the crumpling device. The crumpling device comprises upstream and downstream engagement elements defining a crumple zone therebetween, wherein the upstream engagement element is configured for forcing the paper into the crumple zone, and the downstream element is configured for restricting movement out of the crumple zone for creating the crumples. The upstream element can comprise a driven roller, and the downstream element can comprise non-rotating restriction members causing the paper to bunch up in the crumple zone. The restriction members can be movable to release the crumpled paper from the crumple zone. The restriction members can comprise fingers biased against each other for restricting the flow of paper out of the crumple zone but to release the paper once a pushing force of the paper being fed from the upstream element rises to a threshold.

A paper supply support can be provided for supporting a paper container that contains the sheets arranged as a stack, wherein the paper feeder is configured for drawing the sheets out of the supply container for feeding into the crumpling device. The apparatus preferably accepts a container, which has a removable closure to expose a side of the stack to enable the paper feeder to feed the paper from the container to the crumpling device. The container can be formed as an at least semi-rigid box.

A preferred dunnage accumulator of the apparatus is associated with the crumpling device for receiving and storing the crumpled dunnage for access by a user. The dunnage accumulator can comprise at least a pair of rails or rods extending in downstream direction from the crumpling device. The dunnage accumulator can be configured for supporting the dunnage on sides thereof, preferably the lateral sides thereof, and defines an extraction opening between the sides to enable the dunnage to be removed from the accumulator by pulling the dunnage downwards from below the extraction opening. In embodiments that employ rails, these can be spaced from each other to define the extraction opening.

A dunnage apparatus is also provided, comprising a crumpling device that can be configured for crumpling paper to produce low-density packaging dunnage, and a dunnage accumulator disposed downstream of the crumpling device for receiving and storing crumpled dunnage, wherein the dunnage accumulator can be configured for supporting the dunnage on sides thereof and defines an opening between the sides to enable the dunnage to be removed from the dunnage accumulator by a user pulling the dunnage downwards from below the opening.

Also provided is a method of producing dunnage, comprising the steps of feeding separate sheets of paper into a crumpling device, and crumpling the sheets of paper in the crumpling device to produce low-density packaging dunnage.

The present subject matter allows a plurality of single sheets of paper or other substrate to be fed into a crumpling apparatus for crumpling each individual sheet, or groups of separate sheets, of paper or other substrate. The apparatus provides precise feeding of each individual piece of paper or other substrate. Moreover, the apparatus provides individual crumpled sheets to be utilized in packaging to be used as dunnage for the protection of products contained therein.

Additional advantages and novel features of the examples will be set forth in part in the description which follows, and in part will become apparent to those skilled in the art upon examination of the following description and the accompanying drawings or may be learned by production or operation of the examples. The advantages of the concepts may be realized and attained by means of the methodologies, instrumentalities and combinations particularly pointed out in the appended claims.

BRIEF DESCRIPTION OF DRAWINGS

The drawing figures depict one or more implementations in accord with the present concepts, by way of example only, not by way of limitations. In the figures, like reference numerals refer to the same or similar elements.

DETAILED DESCRIPTION OF PREFERRED EMBODIMENTS

The present subject matter relates generally to an apparatus for crumpling paper sheeting for use in packaging. More specifically, the present subject matter relates to an apparatus for feeding separate pieces or sheets of paper or other substrate into a crumpling apparatus and crumpling the same.

Figure 1:
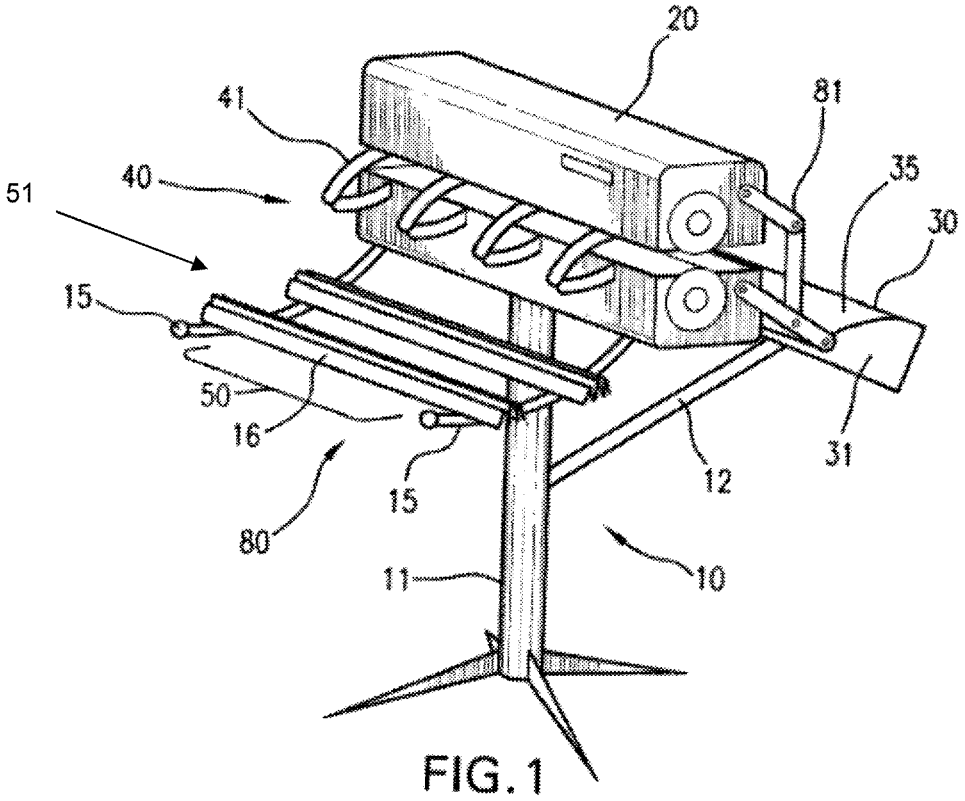
FIG. 1 is a perspective view of an embodiment of a dunnage apparatus.

Now referring to the embodiment crumpling apparatus 10 of FIG. 1, the preferred substrate from which the dunnage is produced is paper, although other suitable substrates can be employed. Dunnage apparatus 10 comprises a paper feeder 20, a tray/table 30 and a paper crumpler 40. The dunnage apparatus 10 can include a floor stand 11, having a support for holding the tray 30. Removable support bar 81 can be disconnected to allow the paper feeder 20 to be opened in case of a paper jam. The preferred tray 30 holds individual sheets of paper, which can be stacked, or can hold a box having sheets of paper in it (or other suitable substrate), as will be explained below. In an alternative embodiment, another support can be used for the supply of material to be crumpled.

The feeder 20 feeds paper from the tray 30 into the crumpler 40. The crumpled paper 16 is received by guides 15 when the paper exits the paper crumpler 40.

Figure 2:
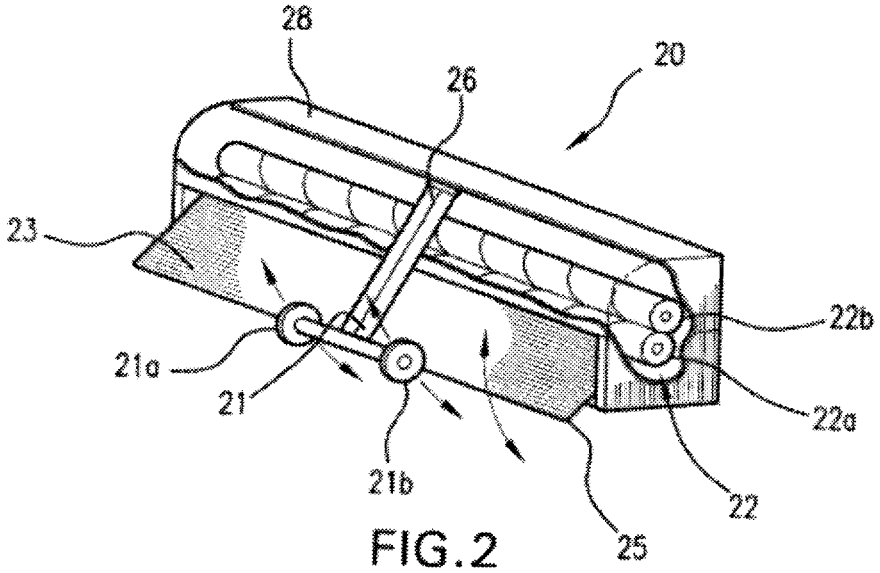
FIG. 2 is a perspective view of a paper feeder thereof.

As shown in FIG. 2, the preferred paper feeder 20 has a housing 28 and comprises a drive roller assembly 21 that feeds individual sheets of paper to a pinch roller assembly 22. The drive roller assembly 21 pulls individual sheets of paper from an infeed side 25 from the tray 30 and towards the pinch rollers 22 and over an infeed guide 23, which is preferably has a sloped surface to help guide the individual sheets of paper. The drive roller assembly 21 is associated with a motor (not shown) for driving the drive rollers 21*a*, 21*b*.

Figure 3:
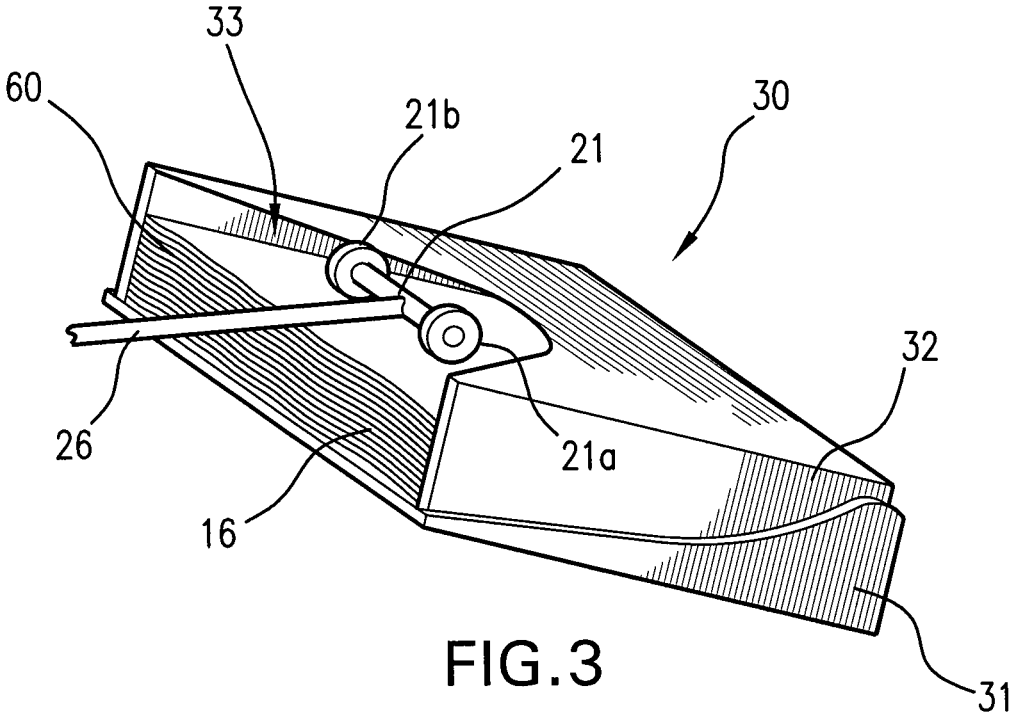
FIG. 3 is a perspective view of a supply tray and a paper stack supply box thereof.
Figure 5:
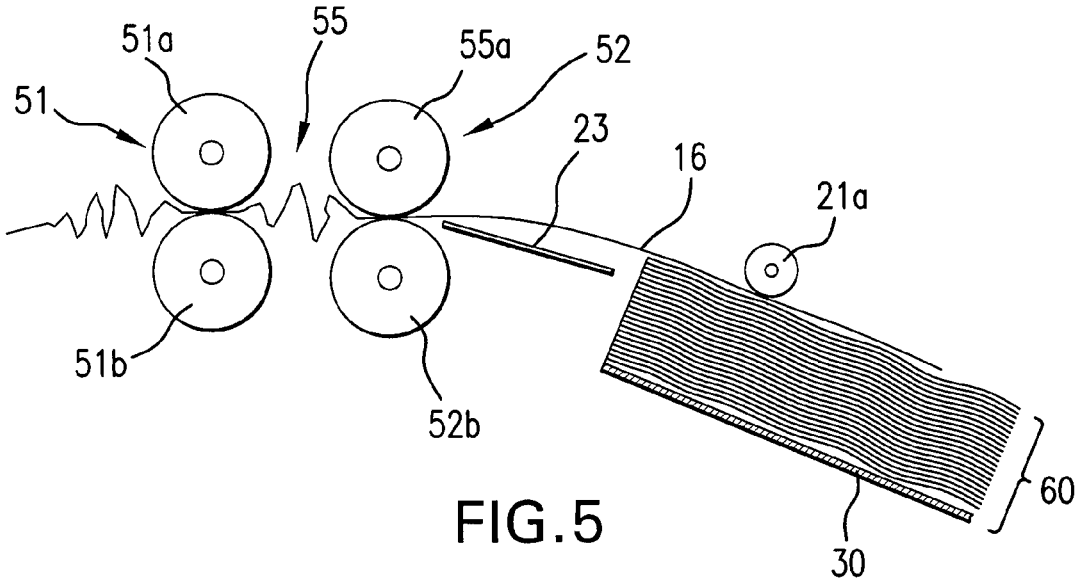
FIG. 5 is a side view of another embodiment of the crumpling apparatus.
Figure 6:
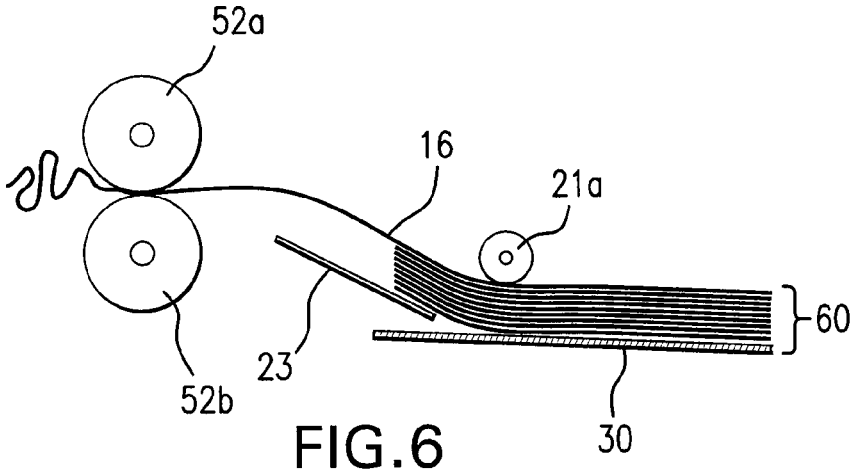
FIG. 6 is a side view of another embodiment of the crumpling apparatus.
Figure 7:
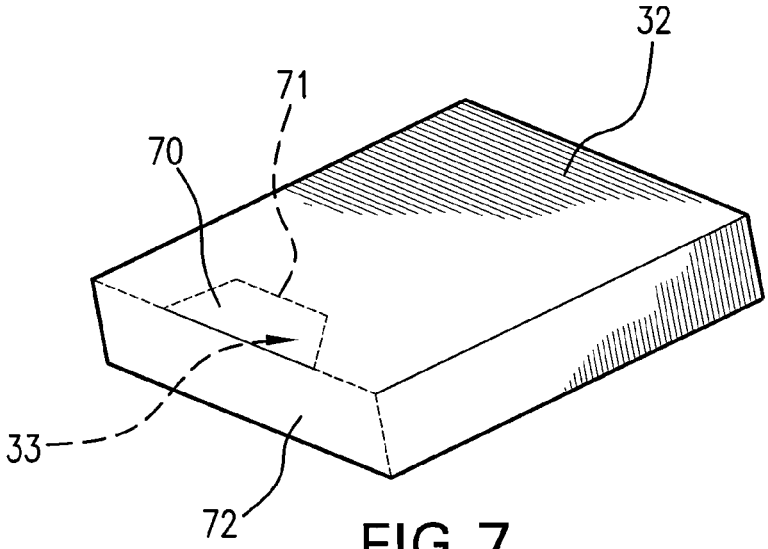
FIG. 7 is a perspective view of a box of paper used with the crumpling apparatus.

In the preferred embodiment, the infeed guide 23 is associated with the drive rollers 21*a*, 21*b* so that the guide 23 and the drive rollers 21*a*, 21*b* move towards or away from each other to adjust the space therebetween according to the changing thickness of stack. Such movement is preferably orthogonal to the direction of flow of sheets along the path through the device. The drive rollers 21*a*, 21*b* can move vertically by means of an attachment 26 to maintain contact with the paper sheets, so that as the sheets are drawn off a stack, the drive rollers 21*a*, 21*b* may move vertically downwards to maintain contact with the paper sheets 16, as shown in FIG. 3. In the preferred embodiment, the infeed guide 23 also or alternatively can move vertically, and can have a longitudinal end, preferably the upstream side that faces the tray, to raise the height of the sheet or sheets being fed into the crumpler 40 to ensure that they are taken up for example by the pinch rollers 22*a*, 22*b*. Preferably, as the drive rollers 21*a*, 21*b* move vertically, so does the infeed guide 23, but in the opposite direction, to ensure that the paper sheeting is properly fed into the pinch roller assembly 22. The infeed guide 23 is positioned in one embodiment in front of the tray 30, as shown in the embodiment of FIG. 5. In another embodiment, the guide 23 is positioned under the front end of the stack 60 or box 32, as shown in FIG. 6, to lift the stack 60 or box 32 to the desired height. In another embodiment, the tray 30 is movable up and down to position the fed sheets 16 and stack 60 as desired.

The pinch roller assembly 22 can also be interconnected with the same or a different motor (not shown) and further provide continuous movement of the sheet(s) into the paper crumpler 40. The pinch roller can comprise one pinch roller 22*a* or more than one pinch rollers 22*a*, 22*b*, where one or both of the pinch rollers 22*a*, 22*b* may be interconnected with the motor for feeding paper sheets therethrough. Other mechanisms can alternatively be employed to take up the sheets 16 from the feeder 20. The pinch roller assembly 22 is preferably also used to force the sheets 16 into a crumple zone in which they are crumpled, as described below. In the preferred embodiment, one of the pinch rollers 22*a*, 22*b* is interconnected with the motor, such that movement of one pinch roller causes movement of the second pinch roller, due to the contact of the one pinch roller with the second pinch roller. The undriven pinch roller 22*b* can also be replaced with a suitable support element against which the driven pinch roller 22*a* can press and move the sheets.

In FIG. 3, a tray 30 is shown holding a container for the supply sheets 16, which is preferably a box 32 or corrugated cardboard or other suitable material. The container can alternatively be a soft envelope of paper or other suitable material, but is preferably at least semi-rigid to help maintain the alignment of the stack regardless of handling and the current thickness of the stack.

Although paper sheets 16 may be placed directly onto the tray, the corrugated box 32 having a access opening 33. With the box 32 placed on the tray, the drive rollers 21*a*, 21*b* come in direct contact with the exposed paper 16 of the stack 60 through the access opening 33, allowing the paper 16 to be fed into the apparatus 10. The opening is preferably covered by a tear-away portion of the box 32 to allow for a quick and easy restocking of the tray 30 once the paper is finished and a fresh box 32 is placed on the tray. Preferably, the tear-away portion 70 is connected to the remainder of the box 32 with a perforated line 71 configured to expose the access opening, to expose one of the end-sheets in the stack, as well as the downstream side 72 of the box 32.

The tray 30 allows a box of single sheet paper of suitable size, and preferably of roughly 24"×18", although other dimensions can be utilized, as will be apparent to one having ordinary skill in the art, to be fed into the drive roller 21 and pinch roller assembly 22. It should be noted that any size paper sheeting, or other substrate, is contemplated by the present invention, although paper is preferred. In one embodiment, the sheeting is around 24"×48". The sheeting may be smaller or larger, such as up to a full pallet size (about 40"×48"), although larger sheets can be used in other embodiments. Moreover, the paper sheeting may be of various densities, such as between 20 lb and 70 lb. Kraft paper. The paper sheeting may be virgin or recycled. Moreover, the paper sheeting may be intermixed so as to deliver 2 sheets or more at once of the same basis weight, or a combination of basis weights. As shown in FIG. 1, the tray is preferably inclined to naturally hold the box 32 in place using rear walls 35 and side tray walls 31 using gravity. Other orientations can alternatively be used.

Figure 4:
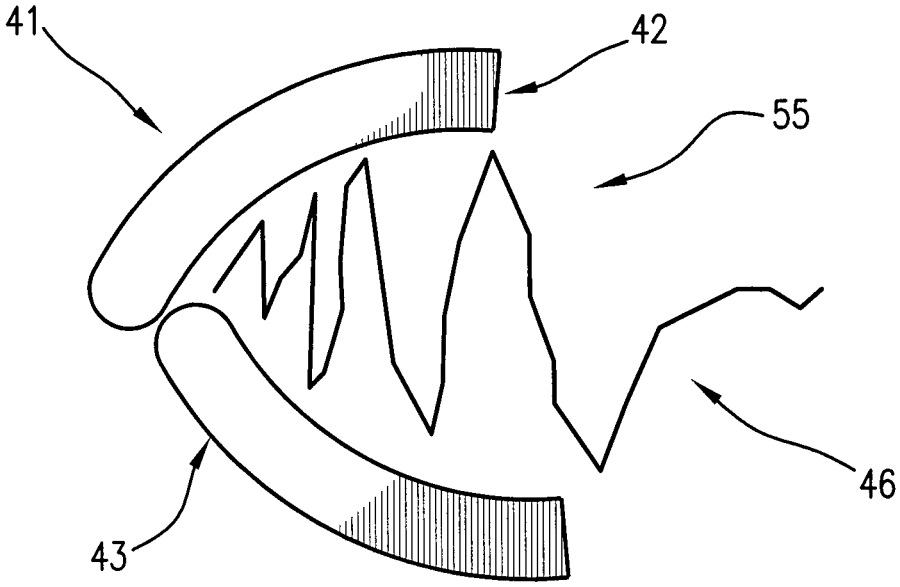
FIG. 4 is a side view of a finger of an embodiment of the crumpling apparatus.

The crumpler 40 can comprise a plurality of fingers 41 disposed downstream of the pinch roller assembly 22. As shown in FIG. 4, the fingers 41 preferably extend longitudinally, and distributed laterally across the outlet of the crumpler 40, and are inclined and preferably curved towards the crumpled sheet 16 to create a blockade that blocks the exit for the sheeting, whereby the sheeting crumples as it is fed into the crumpling zone 55 by the pinch rollers 22*a*, 22*b*, which is located in this embodiment between the pinch rollers 22*a*, 22*b* and the fingers 41. Some of the fingers 41, preferably the top section 42 of fingers 41, is preferably fixed, with opposing fingers 41, preferably the bottom section 43 of fingers 41, are preferably spring-loaded or otherwise mechanically inclined to allow the bottom section 43 to open or rotate away from the top section 42 when the pushing force of the paper by the pinch rollers rises to a threshold.

The crumpled paper 16 is then ejected onto a dunnage accumulator 51 with a receiving surface such as rails 15 or other supports, to preferably accumulate in an accumulation zone 50. The rails 15 or supports are preferably formed of rails, such as made of rods, or another structure to define an extraction opening 80 to allow the accumulated, crumpled sheets to be discharged from the accumulation zone 50 by pulling down on them from between the rails 15. In this manner, the dunnage apparatus 10 can be located overhead on a packaging line, and the user can reach up and pull individual lengths of accumulated, crumpled, sheet dunnage to place in a package about an item to be protected. Each such length would typically be in the shape of a bar or log of paper where separate sheets are used as the paper supply. The dunnage accumulator in another embodiment can be used with a traditional roll-fed crumpling mechanism.

In the preferred embodiments, the crumpling device 40 is configured to form crumples in the paper 16 that, along with their peaks and valleys, are oriented generally in a direction transverse than a direction of travel of the paper 16 through the crumpling device 40, as shown in FIG. 1. The direction from peak to peak in this embodiment is thus generally aligned longitudinally. Other embodiments can crumple the paper in a different direction, such as with the crumples oriented longitudinally or at an angle to the direction of travel of the paper.

In the embodiment shown in FIG. 5, the crumpling mechanism 40 has a downstream portion that uses one or more roller assembly 51 with rollers 51*a*, 51*b* that rotate at a slower speed than the upstream rollers 52*a*, 52*b* of an upstream roller assembly. This causes the sheets 16 to crumple in crumpling zone 55, which are thus discharged from downstream roller assembly 51 as crumpled dunnage.

All of the references specifically identified in the detailed description section of the present application are expressly incorporated herein in their entirety by reference thereto. The term "about," as used herein, should generally be understood to refer to both the corresponding number and a range of numbers. Moreover, all numerical ranges herein should be understood to include each whole integer within the range.

While illustrative embodiments of the invention are disclosed herein, it will be appreciated that numerous modifications and other embodiments may be devised by those skilled in the art. For example, the features for the various embodiments can be used in other embodiments. Therefore, it will be understood that the appended claims are intended to cover all such modifications and embodiments that come within the spirit and scope of the present invention.

What is claimed is:

1. A dunnage apparatus, comprising:

a crumpling device configured for crumpling sheets of an unfolded substrate to produce low-density packaging dunnage in a crumpled condition;

a feeder configured for feeding separate unfolded sheets of the substrate into the crumpling device for crumpling; and a dunnage accumulator associated with the crumpling device for receiving and storing crumpled dunnage for access by a user, wherein the dunnage accumulator is configured for supporting the dunnage on lateral sides thereof and defines an extraction opening between the sides to enable the dunnage to be removed from the dunnage accumulator by a user pulling the dunnage downwards from below the opening.

2. The dunnage apparatus of claim 1, wherein the dunnage accumulator comprises at least a pair of rails extending in downstream direction from the crumpling device and spaced to define the extraction opening.

* * * * *